US009603421B2

(12) United States Patent
Dholakiya

(10) Patent No.: US 9,603,421 B2
(45) Date of Patent: Mar. 28, 2017

(54) CHANNEL SETTING

(71) Applicant: Hasmukh Dholakiya, North Bergen, NJ (US)

(72) Inventor: Hasmukh Dholakiya, North Bergen, NJ (US)

( * ) Notice: Subject to any disclaimer, the term of this patent is extended or adjusted under 35 U.S.C. 154(b) by 0 days.

(21) Appl. No.: 14/827,467

(22) Filed: Aug. 17, 2015

(65) Prior Publication Data

US 2017/0049195 A1 Feb. 23, 2017

(51) Int. Cl.
*A44C 17/02* (2006.01)
*A44C 9/00* (2006.01)

(52) U.S. Cl.
CPC ..... *A44C 17/02* (2013.01); *A44C 9/00* (2013.01)

(58) Field of Classification Search
CPC ..... A44C 9/00; A44C 9/0007; A44C 9/0015; A44C 17/02; A44C 17/0241; A44C 17/025; A44C 17/0208
USPC ..... 63/15, 15.7, 26, 28; 29/8, 896.412
See application file for complete search history.

(56) References Cited

U.S. PATENT DOCUMENTS 665,089 A * 1/1901 Greenberg ..... A44C 17/02 63/15
1,539,940 A * 6/1925 Gaschke ..... B21D 53/44 29/896.42
1,702,893 A * 2/1929 Dinhofer ..... A44C 9/0023 29/896.412
5,003,678 A * 4/1991 Oganesyan ..... A44C 17/04 29/10
6,467,308 B2 * 10/2002 Butler ..... A44C 17/02 63/26
6,568,213 B2 * 5/2003 Butler ..... A44C 17/02 63/26
7,730,743 B2 * 6/2010 Hoover ..... A44C 17/02 63/15
2002/0000097 A1 * 1/2002 Butler ..... A44C 17/02 63/26
2008/0235925 A1 * 10/2008 Hoover ..... A44C 17/02 29/10
2009/0071192 A1 * 3/2009 Bauman ..... A44C 9/00 63/15

FOREIGN PATENT DOCUMENTS

FR 2715806 A1 * 8/1995 ..... A44C 9/0015

OTHER PUBLICATIONS

English translation of French patent.*

* cited by examiner

*Primary Examiner* — Emily Morgan
(74) *Attorney, Agent, or Firm* — Jennifer Meredith, Esq.; Meredith & Keyhani, PLLC

(57) ABSTRACT

A gem setting comprising a first wall with a first groove and a second wall with a second groove, the first wall and the second wall having a channel between them and the first groove facing towards the second groove such that when the plurality of gems are set into the channel the crown of the gems extends above the first wall top and the second wall top; four soldering prongs attached to the ends of the walls and a ring portion, wherein the ring portion is soldered to the four soldering prongs to enclose the plurality of gems in the channel.

17 Claims, 32 Drawing Sheets

CHANNEL SETTING

BACKGROUND OF THE INVENTION

1. Field of the Invention

The present invention relates generally to jewelry and a channel setting.

2. Description of Related Art

Channel settings are generally performed by a jeweler cutting notches in channel walls. The portions of the walls above the notches are bent over the crown of the gem with the jeweler's pliers. With this type of setting, the notches must be carefully aligned on the channel walls so that they will hold the gem in position. Also, the shape of the notches must be carefully cut with hand tools, such as a motorized bur, to match the shape of the gem girdle. Thus, this type of setting can only be used by a skilled jeweler and is labor intensive.

The present invention seeks to provide a channel setting that is easier to manufacture and assemble and hold the gemstones more securely during their placement and after.

SUMMARY OF THE INVENTION

Aspects of the present invention provide a ring apparatus that includes gemstones.

One aspect of the present invention provides a gem setting for holding a plurality of gems having a crown, a pavilion and a girdle, the gem setting comprising: a first wall (10) with a first wall top (12), first wall bottom surface (14), first wall outer surface (16), a proximal first wall end (18), a distal first wall end (20) and a first groove (22) having a first groove upper portion (24), a first groove middle portion (26) and a first groove lower portion (28) and a second wall (30) with a second wall top (32), second wall bottom portion (34), second wall outer portion (36), a proximal second wall end (38), a distal second wall end (40) and a second groove (42) having a second groove upper portion (44), a second groove middle portion (46) and a second groove lower portion (48), the first wall (10) and the second wall (30) having a channel (50) between them and the first groove (22) facing towards the second groove (42) such that when the plurality of gems (e.g. 52, 54) are set into the channel (50) the crown (1000) of the plurality of gems extends above the first wall top (12) and the second wall top (32); four soldering prongs (e.g. 56, 58, 60 and 62) attached to the proximal first wall end (18), the distal first wall end (20), the proximal second wall end (38) and the distal second wall end (40); a ring portion (64) with a ring portion first end (66) and a ring portion second end (68), wherein the ring portion first end (66) is soldered to the proximal first wall end (18) and the proximal second wall end (38) and the ring portion second end (68) is soldered to the distal first wall end (20) and the distal second wall end (40) to enclose the plurality of gems in the channel.

Another aspect of the present invention provides, a gem setting for holding a plurality of gems having a crown, a pavilion and a girdle, the gem setting comprising: a first wall (10) with a first wall top (12), first wall bottom surface (14), first wall outer surface (16), a proximal first wall end (18), a distal first wall end (20) and a first groove (22) having a first groove upper portion (24), a first groove middle portion (26) and a first groove lower portion (28) and a second wall (30) with a second wall top (32), second wall bottom portion (34), second wall outer portion (36), a proximal second wall end (38), a distal second wall end (40) and a second groove (42) having a second groove upper portion (44), a second groove middle portion (46) and a second groove lower portion (48), the first wall (10) and the second wall (30) having a channel (50) between them and the first groove (22) facing towards the second groove (42) such that when the plurality of gems (e.g. 52, 54) are set into the channel (50) the crown (1000) of the plurality of gems extends above the first wall top (12) and the second wall top (32); two soldering prongs attached to at least two of group consisting of the proximal first wall end (18), the distal first wall end (20), the proximal second wall end (38) and the distal second wall end (40); two offset soldering prongs attached to two of the group consisting of the proximal first wall end, the distal first wall end, the proximal second wall end and the distal second wall end; a ring portion (64) with a ring portion first end (66) and a ring portion second end (68), wherein the ring portion first end (66) is soldered to the proximal first wall end (18) and the proximal second wall end (38) and the ring portion second end (68) is soldered to the distal first wall end (20) and the distal second wall end (40) to enclose the plurality of gems in the channel.

DETAILED DESCRIPTION OF THE INVENTION

Figure 1:
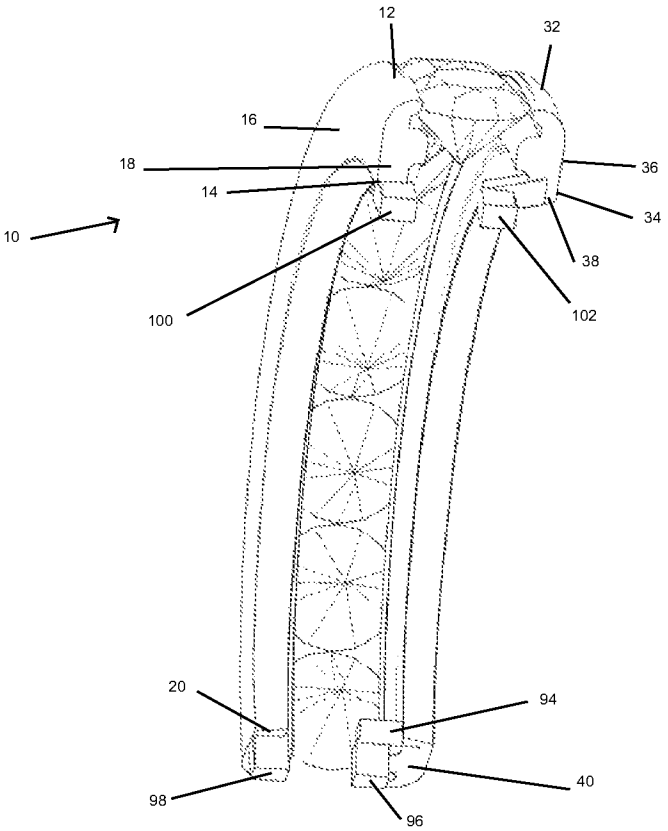
FIG. 1 is a front perspective view of the gemstone setting as in the present invention, showing the setting section.

The present invention provides a gem setting for holding a plurality of gems having a crown (1000), a pavilion (1004) and a girdle (1002), the gem setting comprising: a first wall (10) with a first wall top (12), first wall bottom surface (14), first wall outer surface (16), a proximal first wall end (18), a distal first wall end (20) and a first groove (22) having a first groove upper portion (24), a first groove middle portion (26) and a first groove lower portion (28) and a second wall (30) with a second wall top (32), second wall bottom portion (34), second wall outer portion (36), a proximal second wall end (38), a distal second wall end (40) and a second groove (42) having a second groove upper portion (44), a second groove middle portion (46) and a second groove lower portion (48), the first wall (10) and the second wall (30) having a channel (50) between them and the first groove (22) facing towards the second groove (42) such that when the plurality of gems (e.g. 52, 54) are set into the channel (50) the crown (1000) of the plurality of gems extends above the first wall top (12) and the second wall top (32). There may be four soldering prongs (e.g. 56, 58, 60 and 62) attached to the proximal first wall end (18), the distal first wall end (20), the proximal second wall end (38) and the distal second wall end (40). There may also be a ring portion (64) with a ring portion first end (66) and a ring portion second end (68), wherein the ring portion first end (66) is soldered to the proximal first wall end (18) and the proximal second wall end (38) and the ring portion second end (68) is soldered to the distal first wall end (20) and the distal second wall end (40) to enclose the plurality of gems in the channel. The first groove upper portion (24) may end at and meet the first wall top (12) and the second groove upper portion (44) may end at and meet the second wall top (32). The first groove upper portion (24) may end at and meet the first wall top (12) and is rounded along a portion where the first groove upper portion (24) ends at and meets the first wall top (12). The second groove upper portion (44) may end at and meet the second wall top (32) and is rounded along a portion where the second groove upper portion (44) ends at and meets the second wall top (32). The first groove upper portion (24) is shorter in length than the first groove lower portion (28). The second groove upper portion (44) is shorter in length than the second groove lower portion (48). The first groove curved upper portion may meet the first groove lower portion at a first groove angle (72) and the first groove angle may be less than thirty degrees. The second groove upper portion (24) may meets the first groove lower portion (28) at a first groove angle (72) and the first groove angle (72) may be less than thirty degrees. The second groove upper portion (24) meets the first groove lower portion (28) at a first groove angle (72) and the first groove angle may be less than or equal to the pavilion-crown angle (74) of the gemstone. These angles are important as they ensure the gemstones are held in place, are easier to set and allow light to flow through the setting which provides a sparkle. A portion of the girdle (1002) of each the plurality of gems sits in the first groove (22) and the second groove (42). The pavilion (1004) of the gemstone may be in communication with the first groove lower portion (28) and the second groove lower portion (48).

Figure 2:
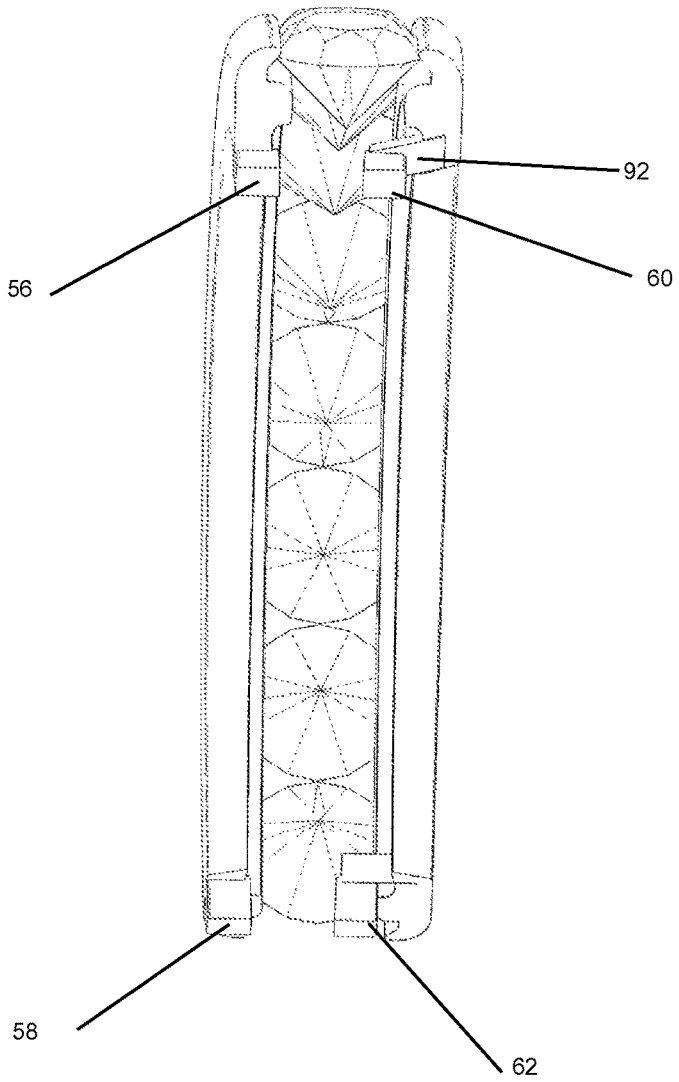
FIG. 2 is a front view of the Gemstone Setting as in the present invention.
Figure 3:
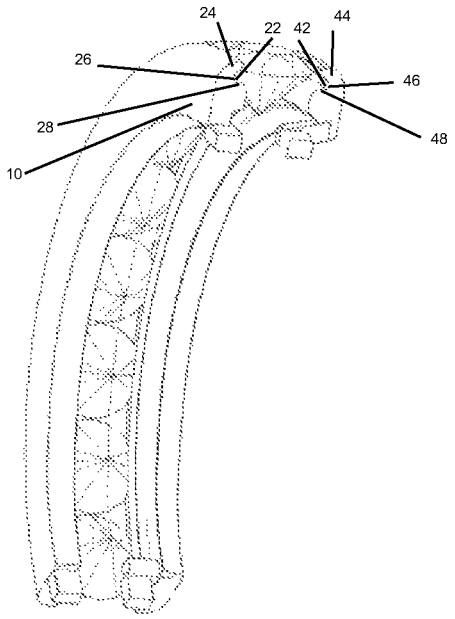
FIG. 3 is a front perspective view of the Gemstone Setting as in the present invention.
Figure 4:
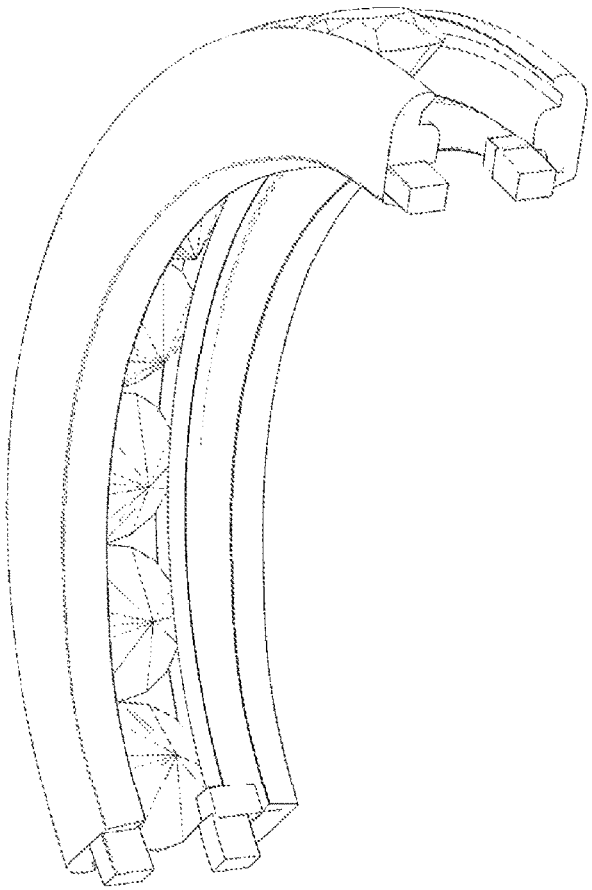
FIG. 4 is a front perspective view of the Gemstone Setting as in the present invention.
Figure 5:
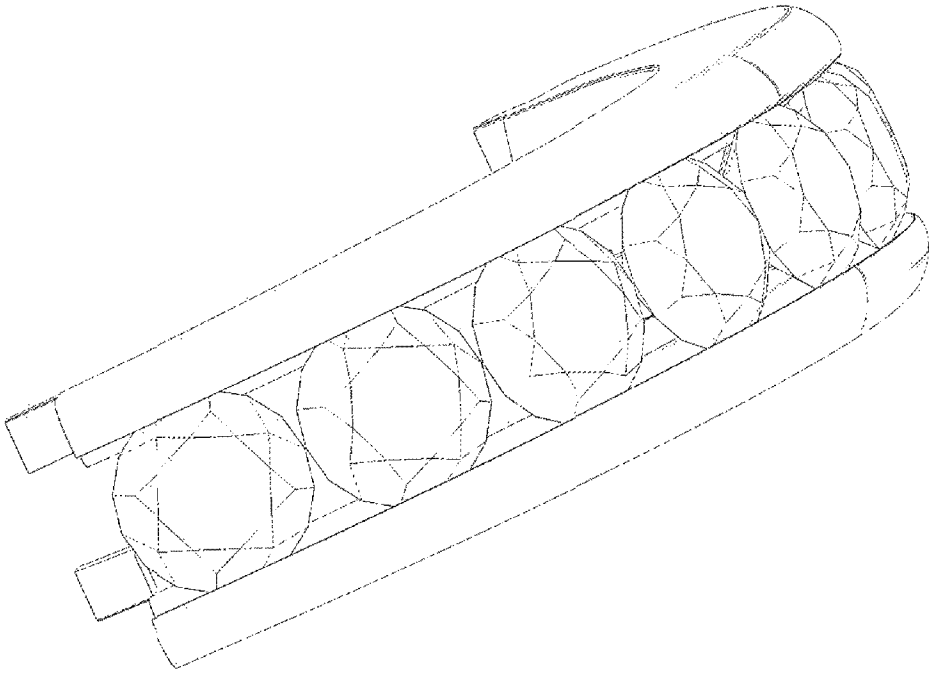
FIG. 5 is a top perspective view of the Gemstone Setting as in the present invention.
Figure 6:
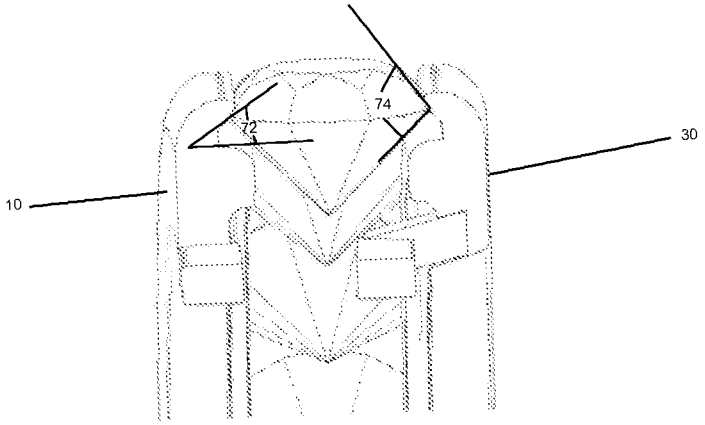
FIG. 6 is a front perspective view of the Gemstone Setting as in the present invention.
Figure 7:
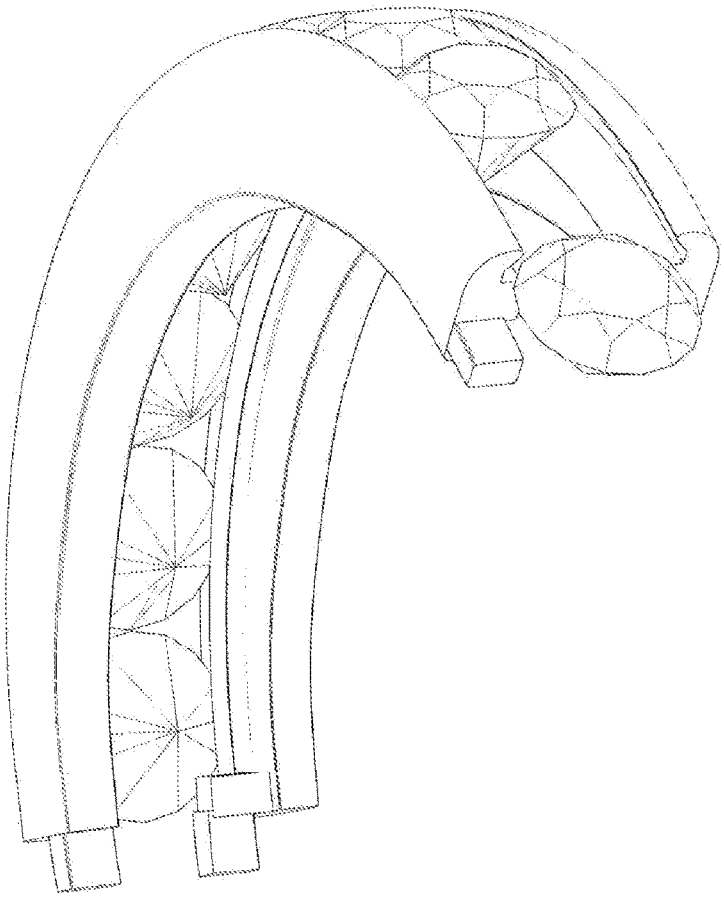
FIG. 7 is a front perspective view of the Gemstone Setting as in the present invention.
Figure 8:
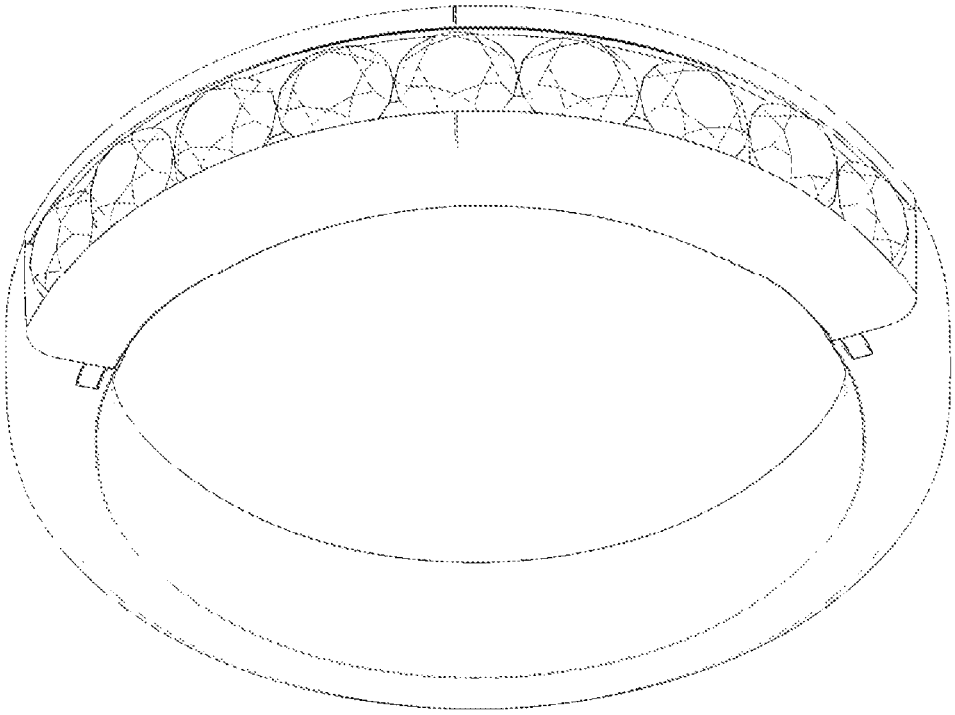
FIG. 8 is a top perspective view of the Gemstone Setting as in the present invention.
Figure 9:
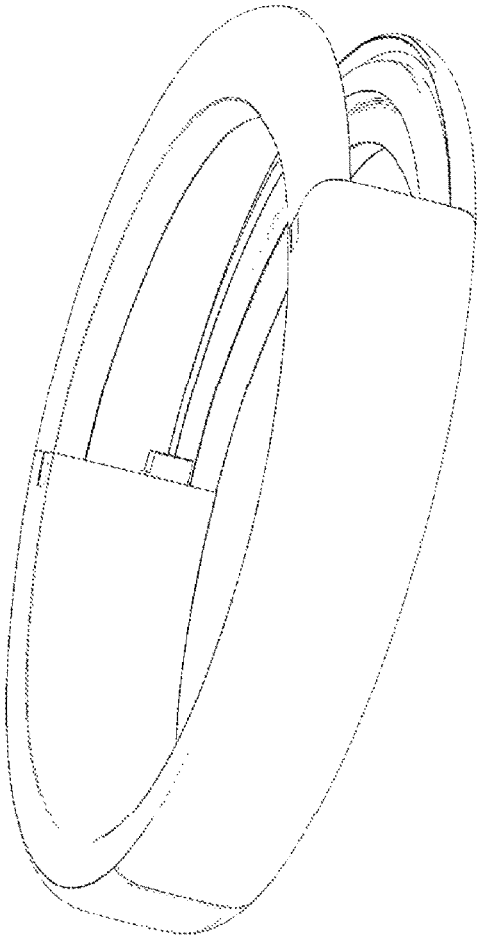
FIG. 9 is a bottom perspective view of the Gemstone Setting as in the present invention.
Figure 10:
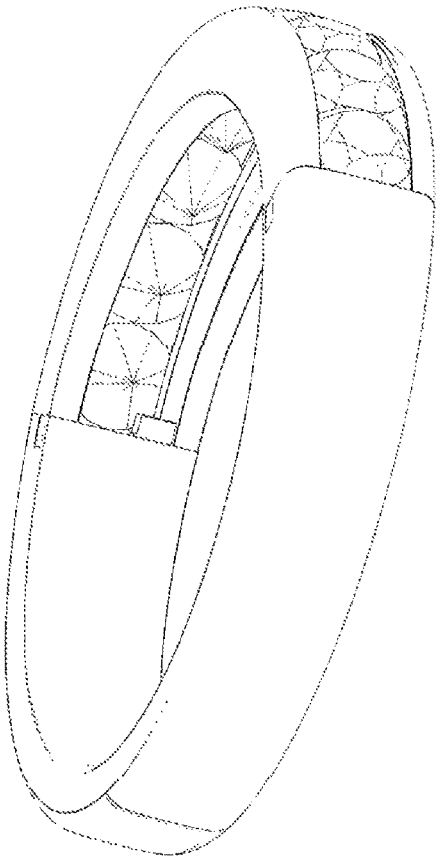
FIG. 10 is a bottom perspective view of the Gemstone Setting as in the present invention.
Figure 11:
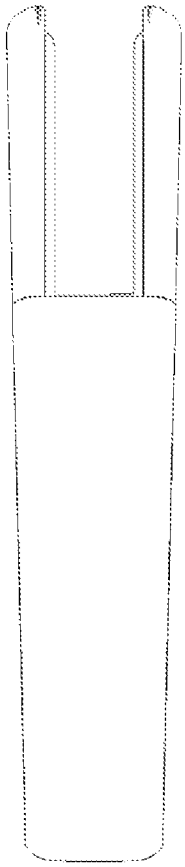
FIG. 11 is a front view of the Gemstone Setting as in the present invention.
Figure 12:
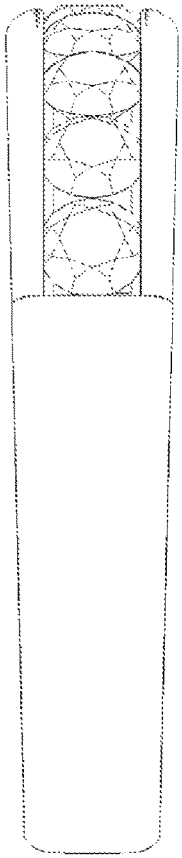
FIG. 12 is a front view of the Gemstone Setting as in the present invention.
Figure 13:
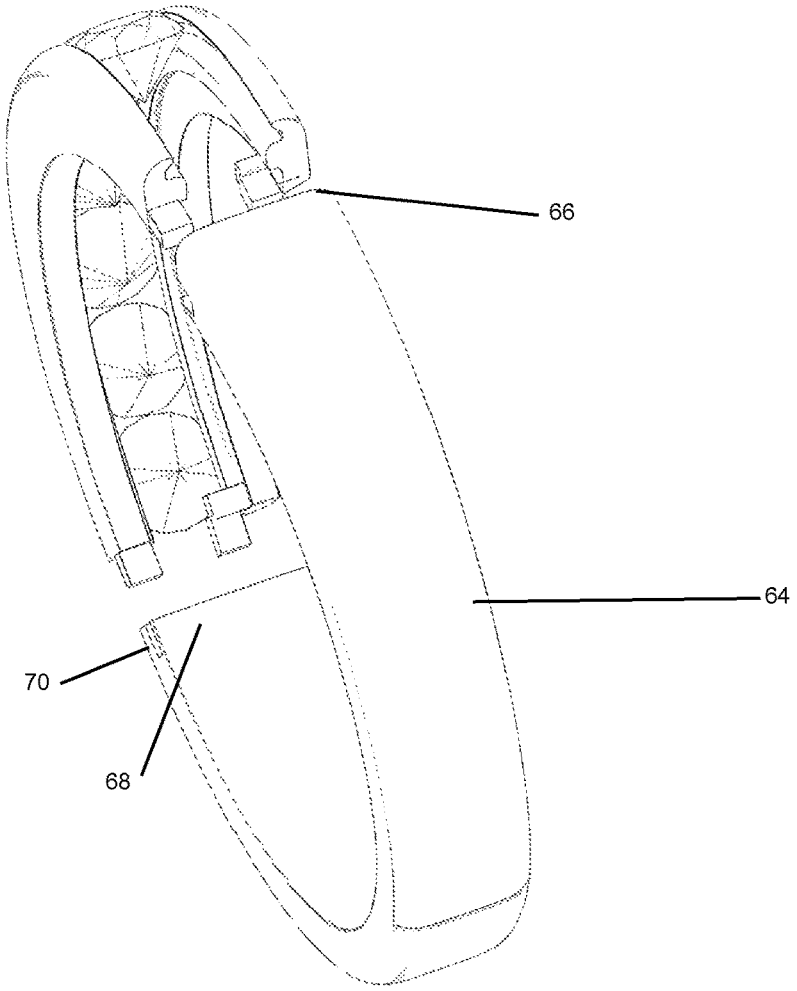
FIG. 13 is a top perspective view of the Gemstone Setting as in the present invention.
Figure 14:
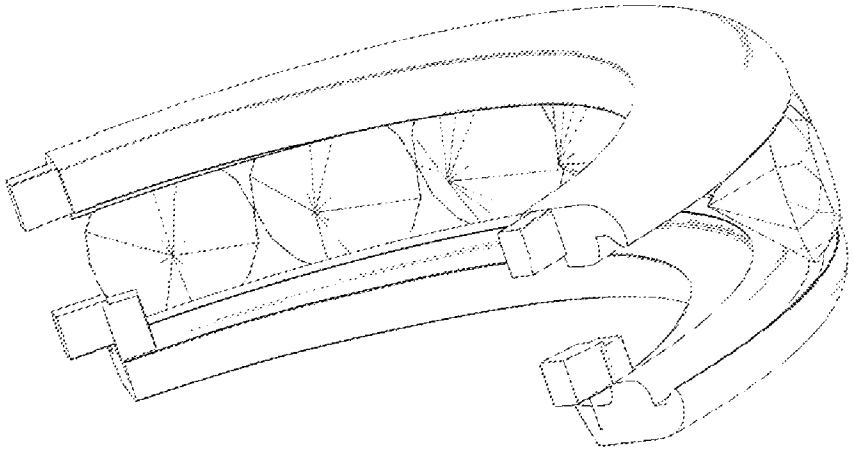
FIGS. 14-17 are front perspective views of the Gemstone Setting as in the present invention.
Figure 15:
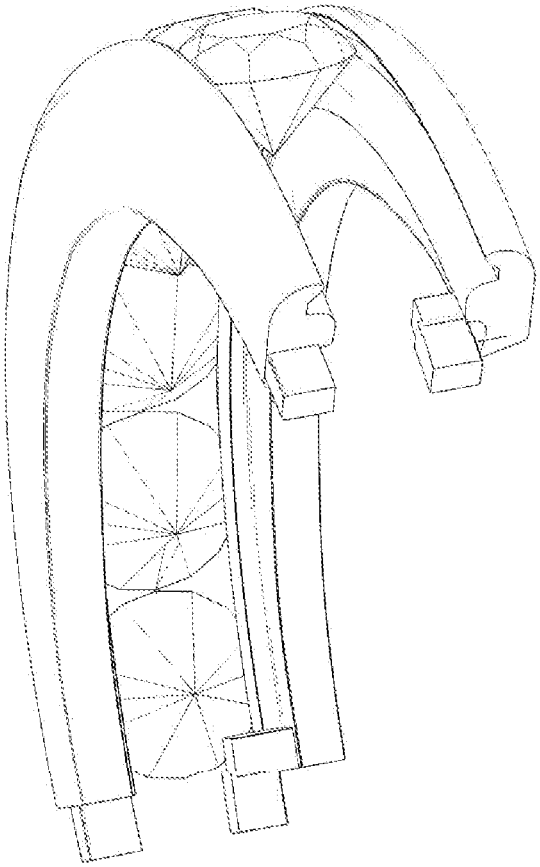
Figure 16:
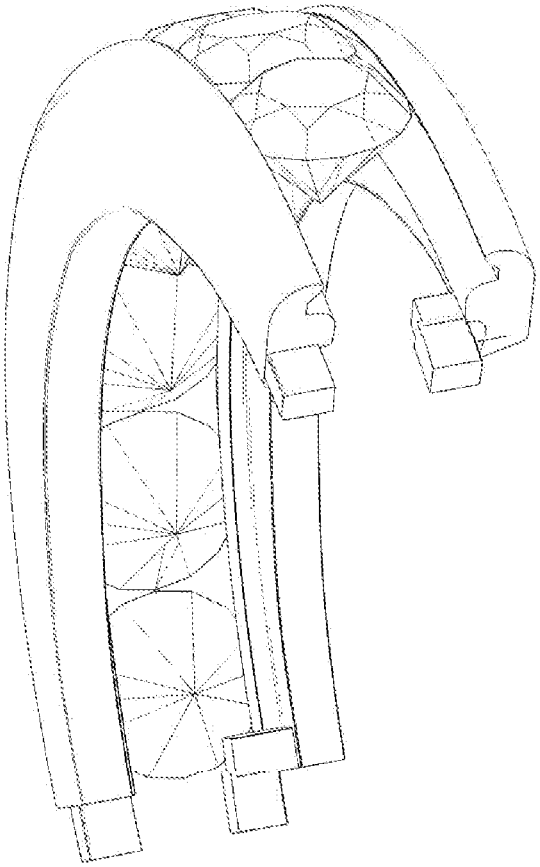
Figure 17:
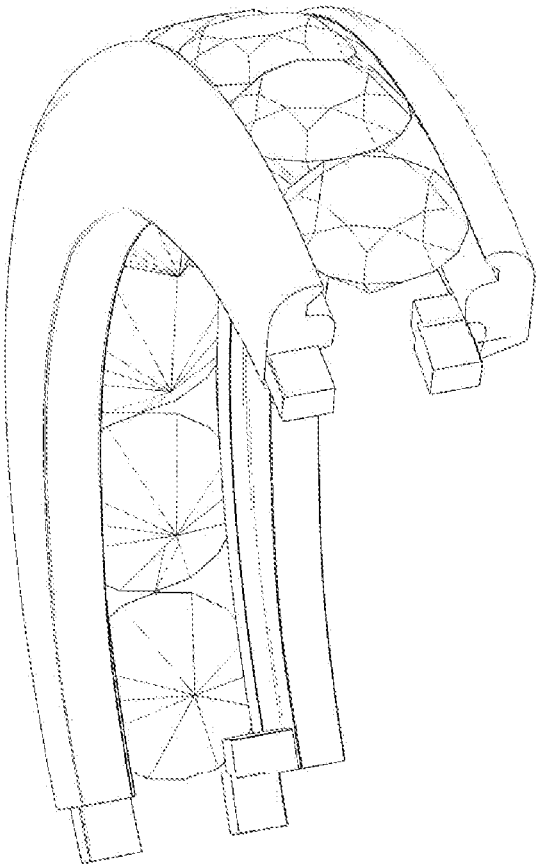
Figure 18:
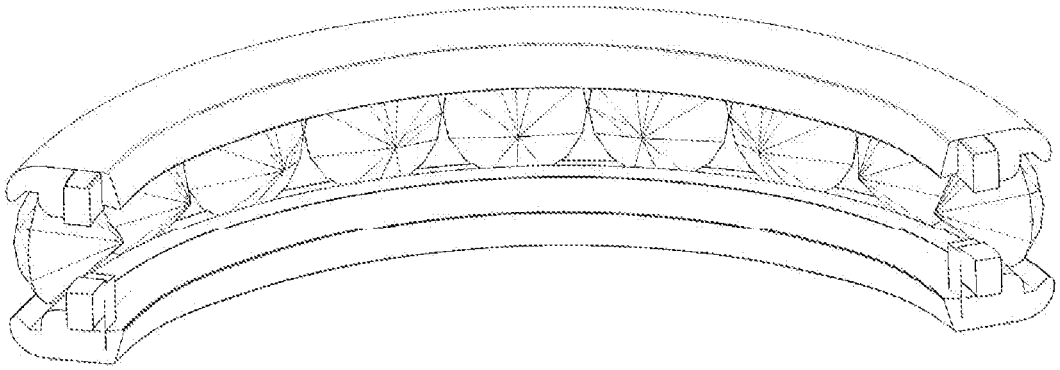
FIGS. 18-25 are bottom perspective views of the Gemstone Setting as in the present invention.
Figure 19:
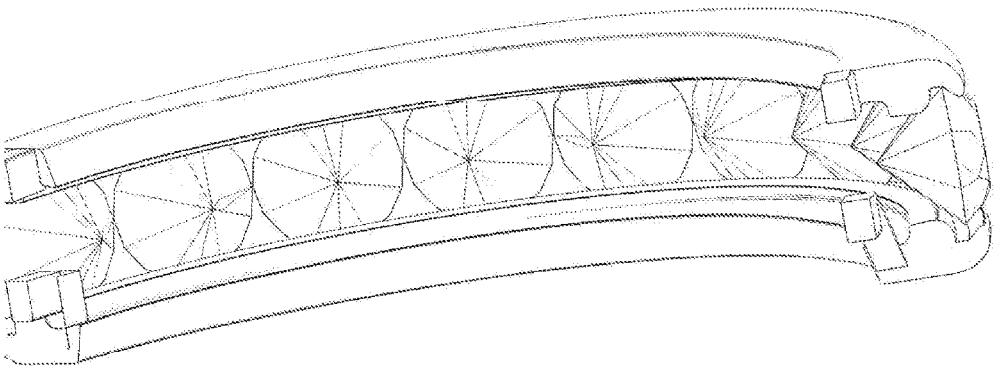
Figure 20:
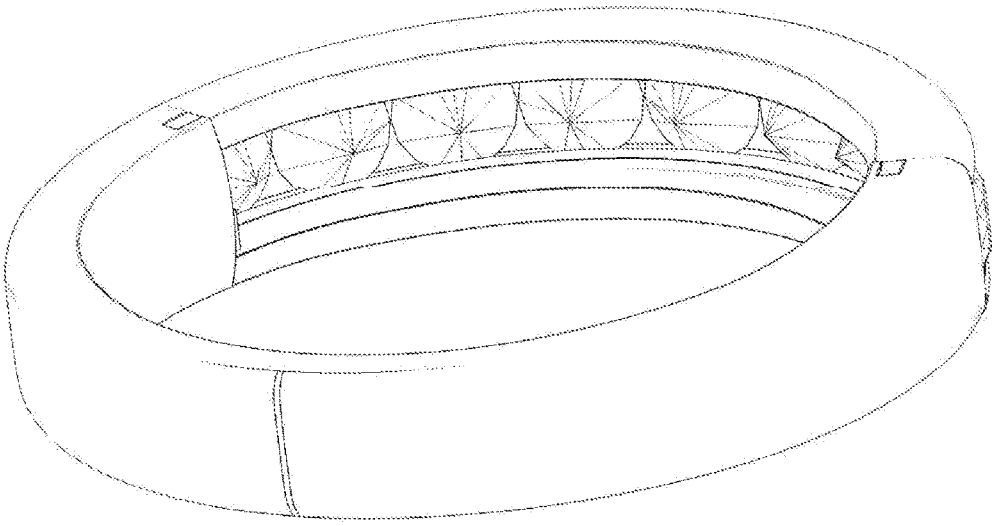
Figure 21:
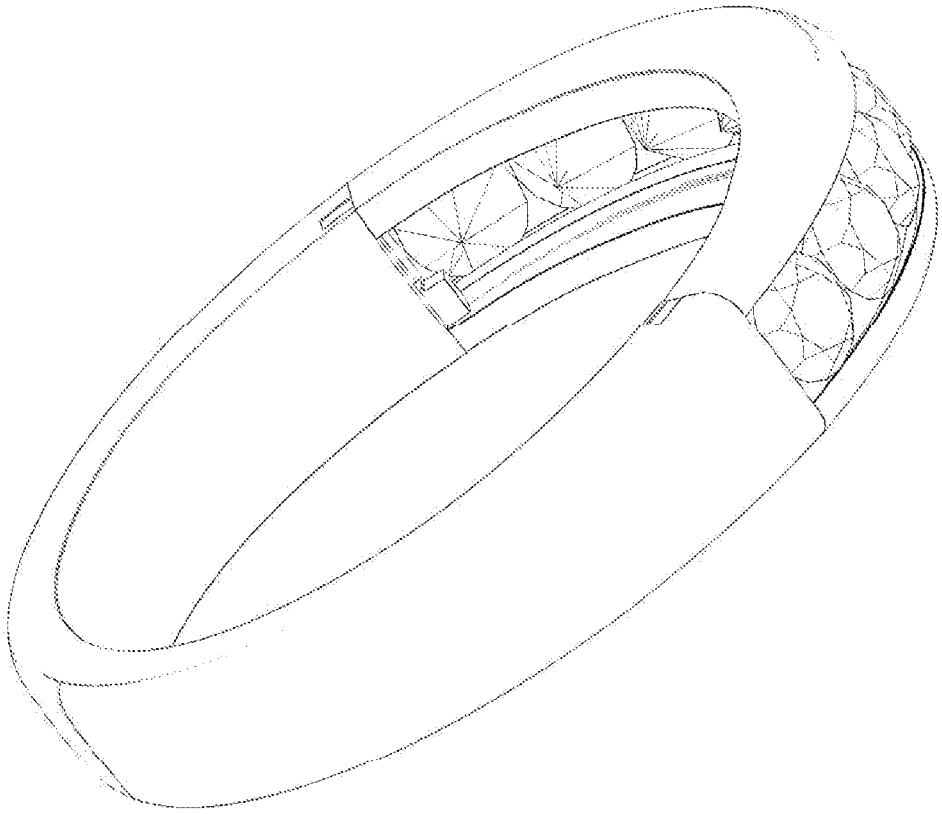
Figure 22:
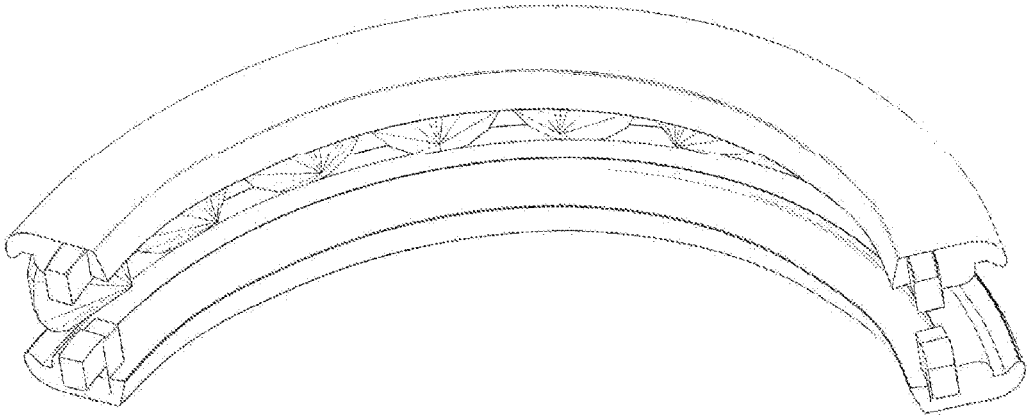
Figure 23:
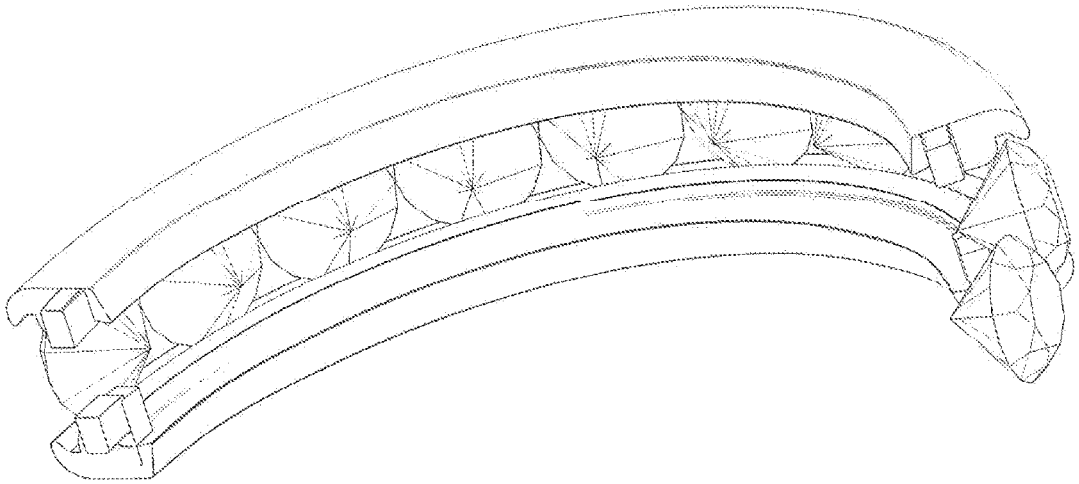
Figure 24:
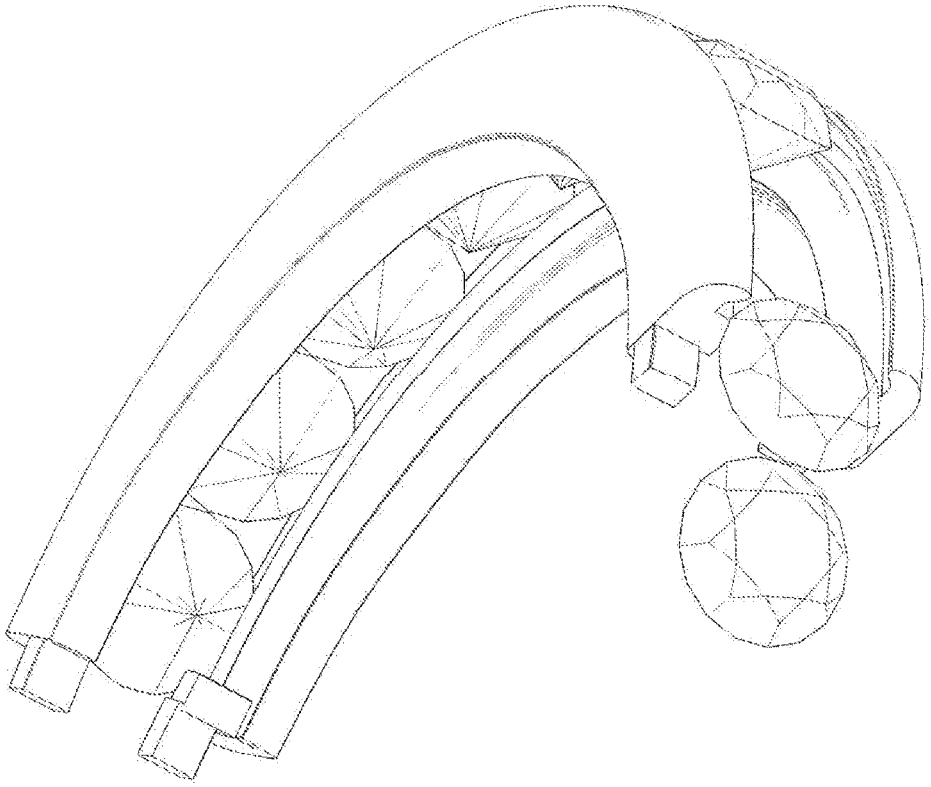
Figure 25:
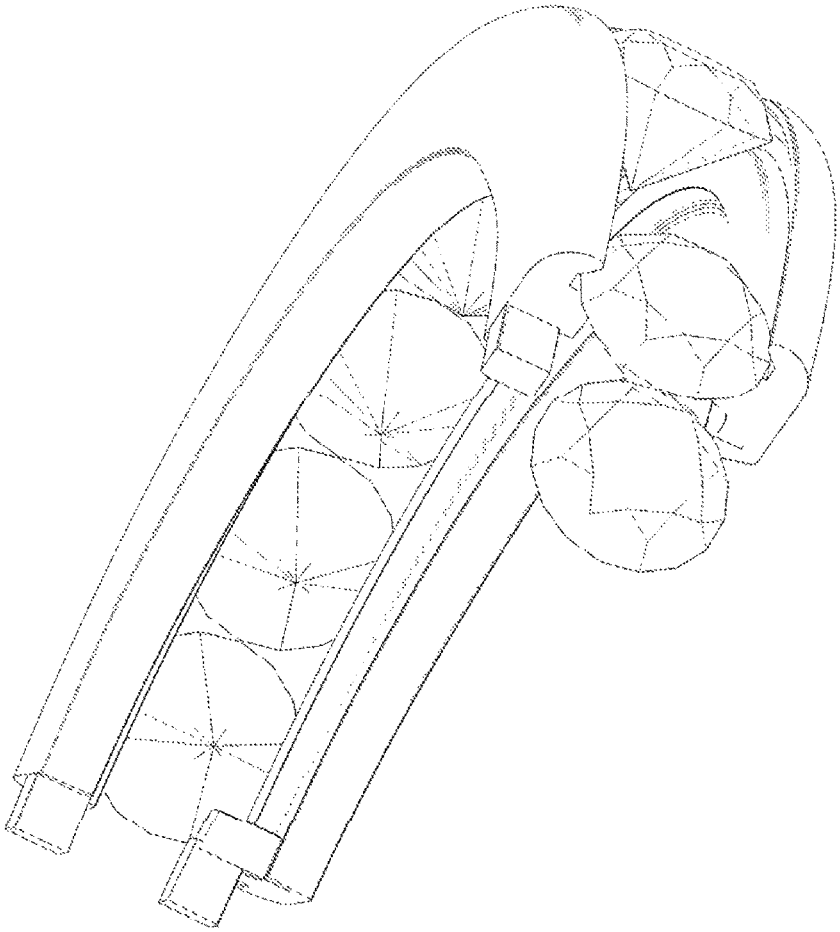
Figure 26:
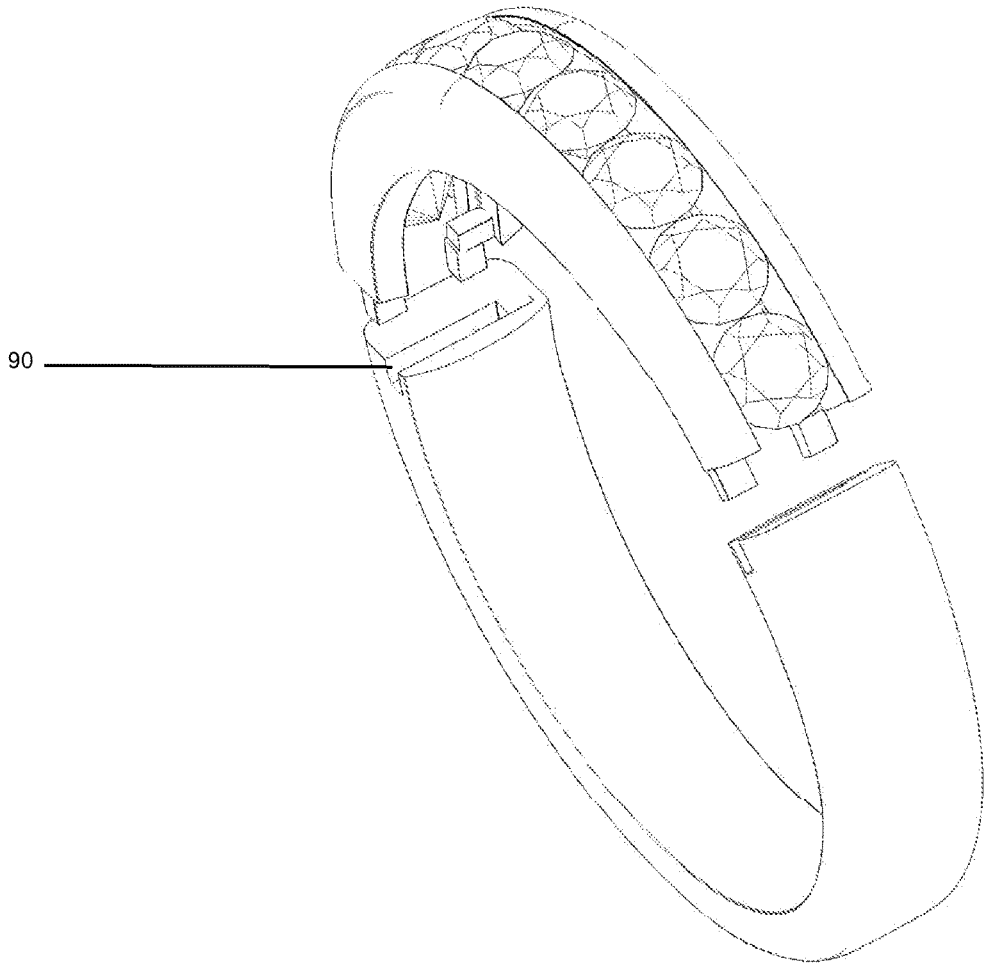
FIG. 26 is a top perspective view of the Gemstone Setting as in the present invention.
Figure 27:
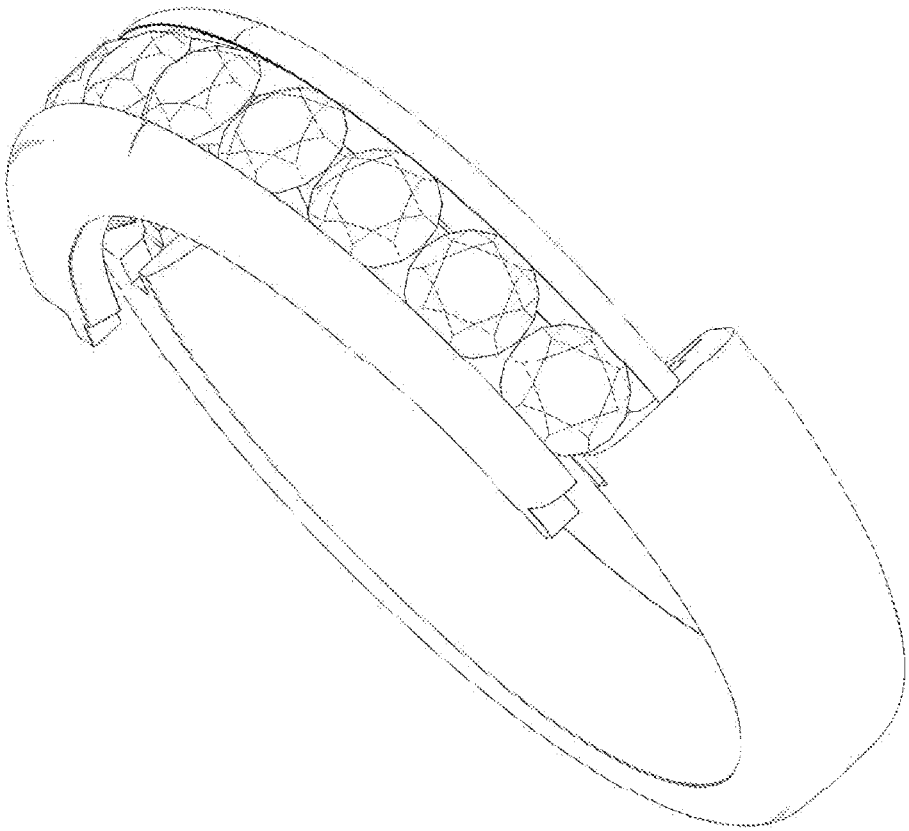
FIG. 27 is a top perspective view of the Gemstone Setting as in the present invention.
Figure 28:
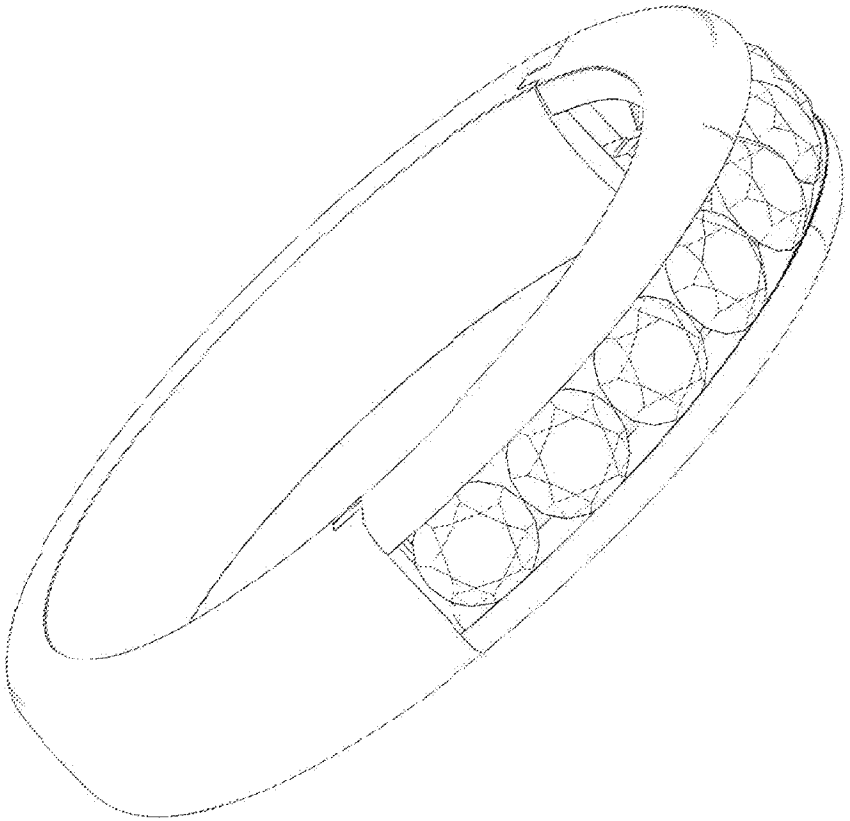
FIG. 28 is a top perspective view of the Gemstone Setting as in the present invention.
Figure 29:
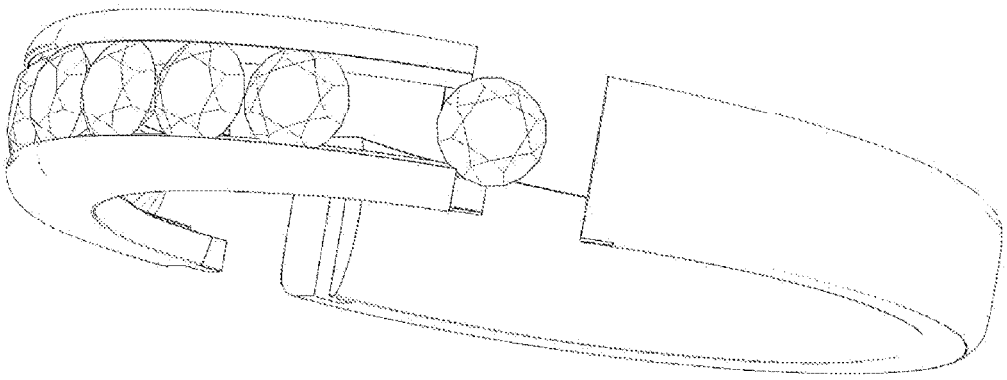
FIG. 29 is a top perspective view of the Gemstone Setting as in the present invention.
Figure 30:
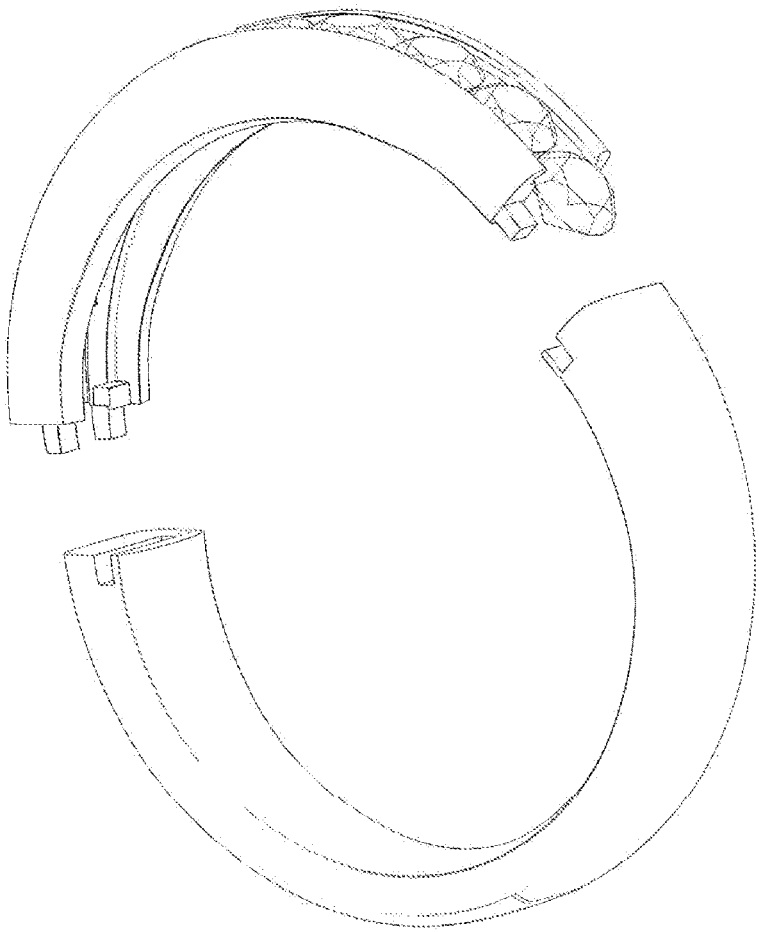
FIG. 30 is a side perspective view of the Gemstone Setting as in the present invention.
Figure 31:
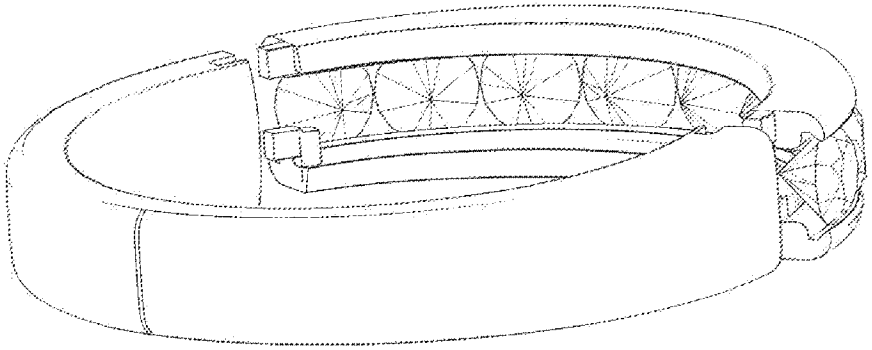
FIG. 31 is a front perspective view of the Gemstone Setting as in the present invention.

Two of the four soldering prongs may be offset and attached to two of the proximal first wall end, the distal first wall end, the proximal second wall end and the distal second wall end. This is a very important feature of the invention as it provides stability during the loading of the diamonds into the channel. As can be seen in, For example, FIG. 25, the diamonds are loaded into the channel. At this point, both ends are open. The offset soldering prongs (See e.g. FIG. 2, offset soldering prongs 60 and 62) prevent the diamonds from falling out during the loading. Also, they move the connection point further away from the outer edges of the ring. This makes the ring more stable and prevents failure of the connection point between the ring portion and the gemstone portion. This may be seen in FIG. 26. As can be seen there is an opening (90) in the ring portion. It may be on the first end (66) or the second end (68). The opening (90) may be a rectangular shape that receives the soldering prongs. The soldering prongs may be heated and slid into the rectangular shaped opening (90). In this way the portion containing the gemstones is fixedly attached to the ring portion. There may be at least one opening in the ring portion first end (66) for receiving at least one of the four soldering prongs. This is to say that there may be a single rectangular opening, or two or more rectangular openings. Any number of prongs and any number of openings may be used as in deemed necessary without departing from the invention. More than one prong may be in one opening. There may also be at least one opening in the ring portion second end (68) for receiving at least one of the at least four soldering prongs.

A gem setting for holding a plurality of gems having a crown, a pavilion and a girdle, the gem setting comprising: a first wall (10) with a first wall top (12), first wall bottom portion (14), first wall outer portion (16), a proximal first wall end (18), a distal first wall end (20) and a first groove (22) having a first groove upper portion (24), a first groove middle portion (26) and a first groove lower portion (28) and a second wall (30) with a second wall top (32), second wall bottom portion (34), second wall outer portion (36), a proximal second wall end (38), a distal second wall end (40) and a second groove (42) having a second groove upper portion (44), a second groove middle portion (46) and a second groove lower portion (48), the first wall (10) and the second wall (30) having a channel (50) between them and the first groove (22) facing towards the second groove (42) such that when the plurality of gems (e.g. 52, 54) are set into the channel (50) the crown (1000) of the plurality of gems extends above the first wall top (12) and the second wall top (32); two soldering prongs (e.g. 96, 98, 100 and 102) attached to at least two of group consisting of the proximal first wall end (18), the distal first wall end (20), the proximal second wall end (38) and the distal second wall end (40), two offset soldering prongs (e.g. 96 and 102) may be attached to two of the group consisting of the proximal first wall end, the distal first wall end, the proximal second wall end and the distal second wall end. This is to say that the offset soldering prongs may be located at any of these positions. A ring portion (64) with a ring portion first end (66) and a ring portion second end (68), wherein the ring portion first end (66) is soldered to the proximal first wall end (18) and the proximal second wall end (38) and the ring portion second end (68) is soldered to the distal first wall end (20) and the distal second wall end (40) to enclose the plurality of gems in the channel. The soldering prongs may be offset by having an extender portion (e.g. 92 and 94).

Figure 32:
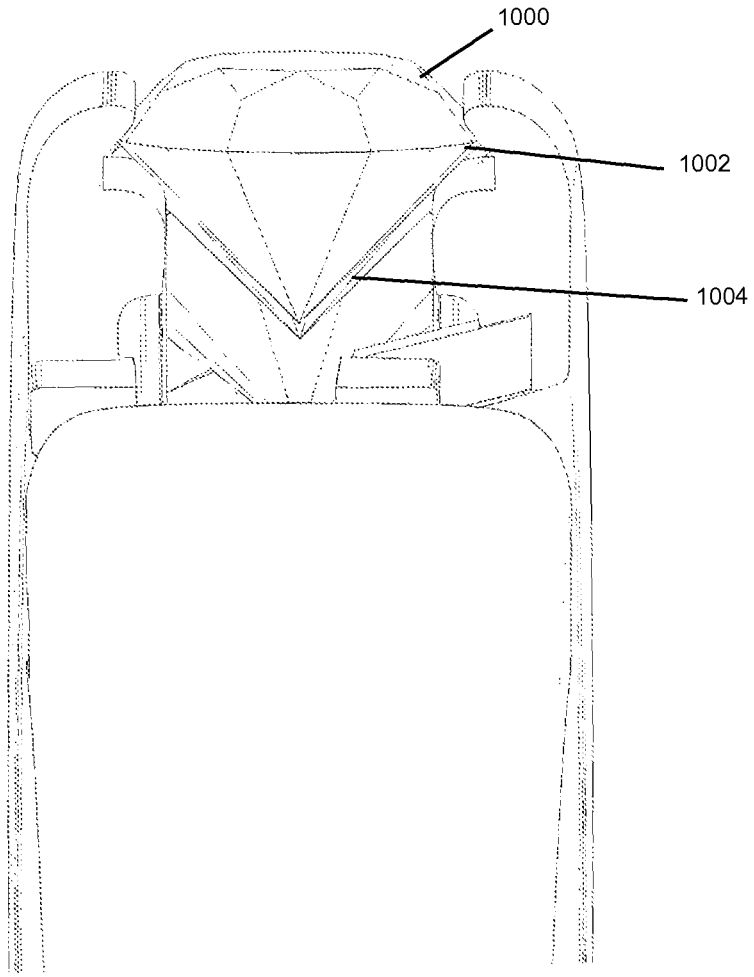
FIG. 32 is a front view of the Gemstone Setting as in the present invention.

The girdle is the widest point of the circumference of a gemstone. It is the perimeter of the stone that separates the gem's pavilion from its crown. The crown is the upper portion of a gemstone that begins just above the girdle. The pavilion is the lower portion of a gemstone that begins just below the 'girdle'. FIG. 32 depicts the crown (1000), girdle (1002) and pavilion (1004).

The present invention has been described in relation to particular examples, which are intended to be illustrative rather than restrictive, with the scope and spirit of the invention being indicated by the following claims and their equivalents.

What is claimed is:

1. A ring, comprising:

a plurality of gems each having a crown, a pavilion and a girdle:

a setting portion, the setting portion is semicircular and comprises:

a first wall with a first wall top, first wall bottom surface, first wall outer surface, a proximal first wall end, a distal first wall end and a first groove having a first groove upper portion, a first groove middle portion and a first groove lower portion and a second wall with a second wall top, second wall bottom portion, second wall outer portion, a proximal second wall end, a distal second wall end and a second groove having a second groove upper portion, a second groove middle portion and a second groove lower portion, the first wall and the second wall having a channel between them and the first groove facing towards the second groove such that when the plurality of gems are set into the channel, the crowns of the plurality of gems extend above the first wall top and the second wall top;

at least four soldering prongs made of solder material, wherein at least one soldering prong is attached to each of the proximal first wall end, the distal first wall end, the proximal second wall end and the distal second wall end, and:

a ring portion, the ring portion is semicircular with a ring portion first end and a ring portion second end, each ring portion end comprises an opening, wherein at least two of the prongs are received in each opening such that the setting portion and the ring portion create a circumference.

2. A ring as in claim 1, wherein the first groove upper portion abuts the first wall top and is rounded along a portion where the first groove upper portion abuts the first wall top.

3. A ring as in claim 1, wherein the second groove upper portion abuts the second wall top and is rounded along a portion where the second groove upper portion abuts the second wall top.

4. A ring as in claim 1, wherein the first groove upper portion meets the first groove lower portion at a first groove angle and the first groove angle is less than thirty degrees.

5. A ring as in claim 1, wherein the second groove upper portion meets the first groove lower portion at a first groove angle and the first groove angle is less than thirty degrees.

6. A ring as in claim 1, wherein two of the at least four soldering prongs are offset from a circumference of the semicircular setting portion, and attached to two of the proximal first wall end, the distal first wall end, the proximal second wall end and the distal second wall end.

7. A ring as in claim 1, wherein a portion of the girdle of each the plurality of gems sits in the first groove and the second groove.

8. A ring as in claim 1, wherein the second groove upper portion meets the first groove lower portion at a first groove angle and the first groove angle is less than or equal to the pavilion-crown angle of the gemstone.

9. A ring as in claim 1, wherein the pavilion of each of the plurality of gems is in communication with the first groove lower portion and the second groove lower portion.

10. A ring, comprising:

a plurality of gems each having a crown, a pavilion and a girdle;

a setting portion, the setting portion is semicircular and comprises:

a first wall with a first wall top, first wall bottom surface first wall outer surface a proximal first wall end, a distal first wall end and a first groove having a first groove upper portion, a first groove middle portion and a first groove lower portion and a second wall with a second wall top, second wall bottom portion, second wall outer portion, a proximal second wall end, a distal second wall end and a second groove having a second groove upper portion, a second groove middle portion and a second groove lower portion, the first wall and the second wall having a channel between them and the first groove facing towards the second groove such that when the plurality of gems are set into the channel, the crowns of the plurality of gems extend above the first wall top and the second wall top;

two soldering prongs made of solder material, two offset soldering prongs made of solder material;

wherein at least one soldering prong is attached to each of the proximal first wall end, the distal first wall end, the proximal second wall end and the distal second wall end, wherein at least one offset soldering prong is attached to each of the proximal first wall end, the distal first wall end, the proximal second wall end and the distal second wall end, and:

a ring portion, the ring portion is semicircular with a ring portion first end and a ring portion second end, each ring portion end comprises an opening, wherein at least two of the prongs are received in each opening such that the setting portion and the ring portion create a circumference.

11. A ring as in claim 10, wherein the first groove upper portion abuts the first wall top and is rounded along a portion where the first groove upper portion abuts the first wall top.

12. A ring setting as in claim 10, wherein the second groove upper portion abuts the second wall top and is rounded along a portion where the second groove upper portion abuts the second wall top.

13. A ring as in claim 10, wherein the first groove upper portion meets the first groove lower portion at a first groove angle and the first groove angle is less than thirty degrees.

14. A ring as in claim 10, wherein the second groove upper portion meets the first groove lower portion at a first groove angle and the first groove angle is less than thirty degrees.

15. A ring as in claim 10, wherein a portion of the girdle of each the plurality of gems sits in the first groove and the second groove.

16. A ring as in claim 10, wherein the second groove upper portion meets the first groove lower portion at a first groove angle and the first groove angle is less than or equal to the pavilion-crown angle of the gemstone.

17. A ring as in claim 10, wherein the pavilion of the gemstone is in communication with the first groove lower portion and the second groove lower portion.

* * * * *